US008201965B2

(12) United States Patent
Yamada et al.

(10) Patent No.: US 8,201,965 B2
(45) Date of Patent: Jun. 19, 2012

(54) MODULAR LIGHT FIXTURES

(76) Inventors: Jose Luiz Yamada, Houston, TX (US); Mark E. Lewis, Houston, TX (US); James A. Lewis, Houston, TX (US)

( * ) Notice: Subject to any disclaimer, the term of this patent is extended or adjusted under 35 U.S.C. 154(b) by 319 days.

(21) Appl. No.: 12/387,623

(22) Filed: May 5, 2009

(65) Prior Publication Data

US 2010/0238673 A1 Sep. 23, 2010

Related U.S. Application Data

(63) Continuation-in-part of application No. PCT/US2009/001734, filed on Mar. 19, 2009.

(51) Int. Cl.
*F21V 21/00* (2006.01)

(52) U.S. Cl. ..... 362/217.01; 362/218; 362/224; 362/225

(58) Field of Classification Search ..... 362/217.12, 362/217.13, 217.14, 224, 225
See application file for complete search history.

(56) References Cited

U.S. PATENT DOCUMENTS

| | | | | |
|---|---|---|---|---|
| 3,569,694 | A | 3/1971 | Comer et al. | 362/382 |
| 4,748,545 | A * | 5/1988 | Schmitt | 362/219 |
| 5,570,947 | A * | 11/1996 | Felland | 362/148 |
| 5,637,964 | A | 6/1997 | Hakkarainen et al. | 315/295 |
| 5,737,318 | A * | 4/1998 | Melnik | 370/254 |
| 6,268,701 | B1 | 7/2001 | Tomme | 315/117 |
| 6,331,756 | B1 | 12/2001 | Belliveau | 315/316 |
| 6,388,396 | B1 | 5/2002 | Katyl et al. | 315/294 |
| 6,828,733 | B1 | 12/2004 | Crenshaw | 315/150 |
| 7,261,436 | B2 * | 8/2007 | Haugaard et al. | 362/225 |
| 2007/0209566 | A1 * | 9/2007 | MacDonald et al. | 114/177 |

FOREIGN PATENT DOCUMENTS

| | | |
|---|---|---|
| EP | 0734196 | 9/1996 |
| EP | 0734197 | 9/1996 |
| GB | 2379497 | 3/2003 |

OTHER PUBLICATIONS

The Light Edge, Inc. "RAP4 Raptor T5/HO Luminaire" brochure (date unknown).

E-conolight A Ruud Lighting Company "Spring Sale on Linear Flurorescents" brochure (date uncertain but brochure shows "Apr./May 2009").

* cited by examiner

*Primary Examiner* — Anabel Ton
*Assistant Examiner* — Danielle Allen
(74) *Attorney, Agent, or Firm* — Mark R. Wisner

(57) ABSTRACT

A modular light fixture having a construction that enables the same fixture to be used for standard on/off operation under control of a wall-mounted switch in a circuit by itself and/or with other fixtures and to be upgraded in "plug and play" fashion to operate independently of other fixtures in the same circuit and/or for stepped dimming. The modular construction of the fixture also allows for safety and ease of maintenance in that ballasts can be replaced without quickly and conveniently without exposing an electrician or maintenance worker to the internal wires of the fixture. The construction of the fixture also provides temperature management by isolating the temperature-sensitive components of the fixture from high temperatures while placing the lamps of the fixture in an enclosure, or shroud, in which temperature is contained so that the lamps operate efficiently. In the event the passive thermal management provided by the construction of the fixture is not enough to maximize the operating efficiency of the fixture and/or the service life of its components, the fixture is upgradeable, again in plug and play fashion, to provide active thermal management.

10 Claims, 4 Drawing Sheets

MODULAR LIGHT FIXTURES

The present application is a continuation-in-part of co-pending International Application No. PCT/US2009/001734, MODULAR, ADAPTIVE CONTROLLER FOR LIGHT FIXTURES, filed Mar. 19, 2009, the disclosure of which is hereby incorporated into this application in its entirety by this specific reference.

The present invention relates to modular light fixtures that, by virtue of their construction and because they are constructed of component parts that may be readily and quickly assembled and/or dis-assembled, provide the advantages of safety, accessibility to the electronic and electrical parts of the controller, thermal management, and the ability to be upgraded with components for monitoring and controlling the fixture. Although not limited to this application, the modular light fixtures of the present invention are particularly suited for use with fluorescent fixtures, particularly fluorescents of the type used for so-called high bay lighting.

The need for energy efficiency has driven innovation in the development of lamps for light fixtures and control systems for lighting fixtures. Fluorescent fixtures have been retrofit to many buildings in place of metal halide fixtures to reduce energy consumption. Although fluorescents have been improved by development of so-called T5 or T5HO fluorescent lamps and "quick start" ballasts and ballasts with electronic controls, they have changed only incrementally over the many years that fluorescents have been in widespread use. The fixtures are generally constructed of a metal shroud with a metal bulkhead assembled to the underside of the shroud. Sockets and reflectors (in fixtures utilizing a reflector) are mounted to the bulkhead inside the shroud to direct light from the lamp(s) downwardly and to support and provide electrical connections to the lamp(s), and ballast(s) are mounted on the top side of the bulkhead (under the shroud and on the top surface of the bulkhead) for providing switching and start-up of the lamps in the fixture. In some fixtures, the bulkhead may be hinged to the shroud to facilitate access to the ballast(s) and in other fixtures, the reflector(s) are integral with the shroud.

Although a time-tested design, existing fluorescent fixtures are characterized by a number of disadvantages and limitations. If the ballast of certain types of fluorescent fixtures fails, for instance, the lamps and reflector(s) must be removed and the bulkhead, or socket bracket, dropped out of the shroud (or if the bulkhead is hinged to the shroud, the bulkhead is pivoted downwardly) to access the ballast(s). Removing and replacing the lamps and reflector(s) (in the type of fixture in which the reflectors are not integral with the shroud) is time-consuming and, depending upon the type of fixture, requires that wires inside the fixture be unplugged and re-plugged into appropriate connectors and/or cut and spliced, creating the possibility of improper wiring. Further, when the fixture is opened to access the ballasts and internal wiring, the person (s) servicing the fixture are in close proximity to the electrical parts of the fixture. Even though power to a fixture or circuit is turned off when the fixture is serviced, there is the possibility of an error that could result in contact with a live wire (and some such fixtures operate at 480V), creating a potentially dangerous situation, especially when the fixture is located twenty or more feet above the floor of the building as in the above-mentioned high bay buildings.

Another disadvantage of known fixtures is highlighted by the development of the above-mentioned T5/T5HO lamp. The T5 lamp is smaller than a T8 lamp, making it possible to mount, for instance, six T5 lamps in a fixture roughly the same size as a four lamp T8 fixture, thereby producing more light from a smaller fixture. However, mounting more lamps in a fixture can create temperature problems in the fixture. T5 lamps (like most fluorescent lamps) operate more efficiently at higher temperatures, but the component parts of the ballast, especially electronic ballasts, can be damaged by heat. Ballasts are available that operate at temperatures up to 90° C. (as compared to 60° and 65° C. ballasts that can fail at the temperatures to which they are exposed when used with T5 lamps), but temperature management is a problem, even in fixtures utilizing T8 lamps, in part because of the downward-facing, concave shape of the fixture, which effectively traps heat in the fixture. Ballast manufacturers may warrant their ballast for a certain operating life, but only as long as temperature does not exceed 90° C., and a heat sensitive label or tape is affixed to the outside of the ballast cover to provide a visual indication when/if temperature exceeds 90° C., in which case the ballast warranty is invalidated.

Fluorescent fixtures are also available in which the ballasts are mounted under the shroud and/or reflectors and that do not require removal of the lamps and reflector(s) for access to the ballasts. Such fixtures are common in commercial and office buildings, and some residential construction, with suspended ceilings and/or and in which headroom and/or the space between the top of the fixture and the underside of the roof or ceiling may be limited, and also in rooms such as kitchens that require energy efficient, bright area lighting. However, the ballasts of such fixtures are mounted within or under the shroud (or reflector) where the lamps are located such that the ballasts are exposed to the heat of the lamps. A fixture is known that is provided with what is characterized as a "removable ballast," accessible from the bottom of the fixture, but no provisions are made in that fixture for thermal management, nor is that fixture designed in a way that would be adaptable for controlling the operating temperatures of the ballast or the lamps. The patent literature includes U.S. Pat. No. 6,268,701, which describes a fixture having the ballast mounted within the housing with a fan that is switched on to blow air over the ballast when the light is turned on. However, the fixture described in that patent is itself characterized by certain disadvantages and limitations that affect the utility of that invention. Specifically, as set out above, the lamps of a fluorescent fixture operate more efficiently at higher temperatures, but blowing the air through the fixture over the ballast as described in that patent cools not only the ballast but also the lamps. Note also that if ambient temperature is 30° C. for instance, the fan blows hot air over the ballast of the fixture disclosed in this patent, with the potential for compromising the efficiency and/or durability of the ballast.

Plug-in, so-called "emergency ballasts" are available (see, for instance, Cat. Nos. E-ACLEB0800D, -1400D, and -3000D of the E-conolight (Sturtevant, Wis.) catalog, www.e-conolight.com). However, so far as is known, such ballasts are intended for temporary, limited duty (the "single lamp field installable Plug-N-Go emergency ballast" described in the E-conolight catalog is capable of operating "one lamp for 90 minutes"), perhaps because such ballasts leave high voltage wiring exposed in violation of good safety practices. Further, such ballasts may require a dedicated fixture and/or can only be used with fixtures of a certain configuration (the emergency ballast offered in the E-conolight catalog requires that the "fixture must be purchased with 'E' option"). Nor can such ballasts be used, so far as is known, in fixtures controlled by remote control or photosensors, or that are part of a centrally-managed, lighting control system.

One fixture, available from The Light Edge, Inc. (Tualatin, Oreg., www.thelightedge.com) addresses this temperature management problem by attaching an enclosed ballast to the aluminum housing of the fixture. However, the fixture was very expensive and, despite this construction, limited by its upside-down, bowl shape (which traps, or contains, the heat produced by the lamps) and the need to remove the lamps and reflectors to access the ballasts. Ballasts have also been designed with cable connectors to simplify ballast replacement. However, these ballasts are of conventional design and the wiring harness must be enclosed, so the ballast is internal to the fixture or is provided with a secondary enclosure that adds cost and may adversely affect heat dissipation.

It is, therefore, an object of the present invention to provide a lighting fixture that overcomes these disadvantages and limitations that is of modular construction and that is adapted for use with different lamps, including without limitation fluorescents, metal halides, LEDs, and halogen lamps.

Another object of the present invention is to provide a light fixture having a ballast module that is adapted for quick and easy assembly to the light fixture on site and/or to an existing light fixture that is configured so that the ballast module can be releasably mounted to the fixture.

Another object of the present invention is to provide a lighting fixture in which the ballasts and other electronic components are insulated from the heat produced by the lamps and that does not require disassembly of the fixture in the event the ballasts need to be replaced and/or other maintenance needs to be performed on the fixture.

Another object of the present invention is to provide a lighting fixture that is easily and quickly assembled on-site and a ballast module that is easily and quickly assembled to the lighting fixture, or to an existing lighting fixture, on-site.

Another object of the present invention is to provide a lighting fixture that provides easy access to ballasts and other electronic components from above the fixture.

Yet another object of the present invention is to provide a lighting fixture that incorporates a thermal management system for optimizing the life and operating efficiency of the components of the fixture by mounting the electronic components in an enclosure, or compartment, that is separate and insulated from the lamps.

Another object of the present invention is to provide a light fixture incorporating passive and active temperature management for increasing the efficiency of the lamps as well as the service life of the electronic components of the fixture.

Another object of the present invention is to provide improved safety in that the structure of the fixture reduces the need for handling the electrically conductive components of the fixture, for instance, when a ballast must be changed.

Similarly, it is an object of the present invention to provide a lighting fixture in which the time required to change ballasts, or otherwise service the fixture, is reduced.

Similarly, it is an object of the present invention to provide a lighting fixture having a construction that is adapted for releasably mounting a ballast module thereto, the ballast module being easily and quickly detached from the fixture for ease of maintenance.

Another object of the present invention is to provide a lighting fixture optimized for use with the targeted system for switching electrical appliances described in International Application No. PCT/US2008/003845, TARGETED SWITCHING OF ELECTRICAL APPLIANCES AND METHOD, filed Mar. 24, 2008, and/or as part of a wireless or wired control network as described in co-pending application Ser. No. 12/284,394, POINT OF USE AND NETWORK CONTROL OF ELECTRICAL APPLIANCES AND METHOD, both commonly owned, and the disclosures of which are hereby incorporated into this application in their entireties by these specific references.

Yet another object of the present invention is to provide a lighting fixture having a construction that provides all necessary lighting functions in its basic form but that can also be upgraded, without structural changes, to include microprocessor control and/or active thermal management.

This listing of several of the objects of the present invention is intended to be illustrative, and is not intended to be a complete listing of all of the objects of the invention; instead, this listing of several objects of the present invention is intended to be illustrative in the sense that the invention addresses many needs and solves many problems, not all of which are listed here, and that are known in the art. Other objects, and the many advantages of the present invention, will be clear to those skilled in the art from the detailed description of the embodiment(s) of the invention and from the drawings appended hereto. Those skilled in the art will recognize, however, that the embodiment(s) of the present invention described herein are only examples of specific embodiment(s), set out for the purpose of describing the making and using of the present invention, and that the embodiment(s) shown and/or described herein are not the only embodiment(s) of a light fixture constructed in accordance with the teachings of the present invention.

The present invention addresses the above-described needs by providing a light fixture comprising a shroud having sockets mounted therein for supporting and making electrical connection to one or more lamps mounted in the sockets. First and second connectors are mounted to the shroud and electrically connected to the sockets mounted in the shroud and a ballast module is detachably mounted to the shroud on said connectors, the ballast module comprising the electrical circuitry for energizing and operating the lamps, the electrical connections to the electrical connections to the ballast module being made when the ballast module is mounted to the shroud.

Also provided is a modular light fixture comprised of a shroud and a ballast module, the ballast module comprising the electrical circuitry for energizing and operating the lamps of the fixture. The ballast module is mounted to the shroud and makes electrical connections to the lamps supported in the shroud on first and second connectors mounted to the shroud, the first and second connectors being spaced apart from each other by a specified distance whereby the ballast module is mounted to or removed from the shroud in convenient and quick fashion for ease of service.

In another aspect, the present invention provides a modular light fixture comprised of a shroud and a ballast module, the ballast module comprising the electrical circuitry for energizing and operating the lamps of the fixture. Modules are detachably mounted to the ballast module for actively cooling the electrical circuitry within the ballast module and/or for operating the electrical circuitry within the ballast module under control of an external network.

In yet another aspect, the present invention provides a modular light fixture of a construction that manages the heat produced by operation of the lamps in the fixture. Specifically, the heat sensitive electrical circuitry of a ballast module is insulated from the heat produced by operation of the lamps by mounting the ballast module to a shroud in which the lamps are mounted with an air gap between the ballast module and the shroud. In an alternative embodiment, the passive thermal management provided by mounting the ballast module to the shroud with an air gap therebetween is enhanced by active thermal management provided by a fan module mounted to the ballast module for drawing ambient air over the electrical circuitry in the ballast module.

Also provided is a method of managing the heat produced by operating a light fixture comprising the steps of containing the heat produced by the lamps of the fixture within a shroud and isolating the heat-sensitive electrical components for energizing the lamps in the fixture from the heat produced by the lamps of the fixture by mounting a module containing the heat-sensitive electrical components to the shroud with an air gap between the shroud and the module.

Referring now to the figures, FIGS. 1A and 1B show end and longitudinal sectional (taken along the line A-A in FIG. 1B) views, respectively, of a first embodiment of a modular light fixture constructed in accordance with the teachings of the present invention, the ballast wiring not being shown in FIG. 1A for purposes of clarity.

Figure 1B:
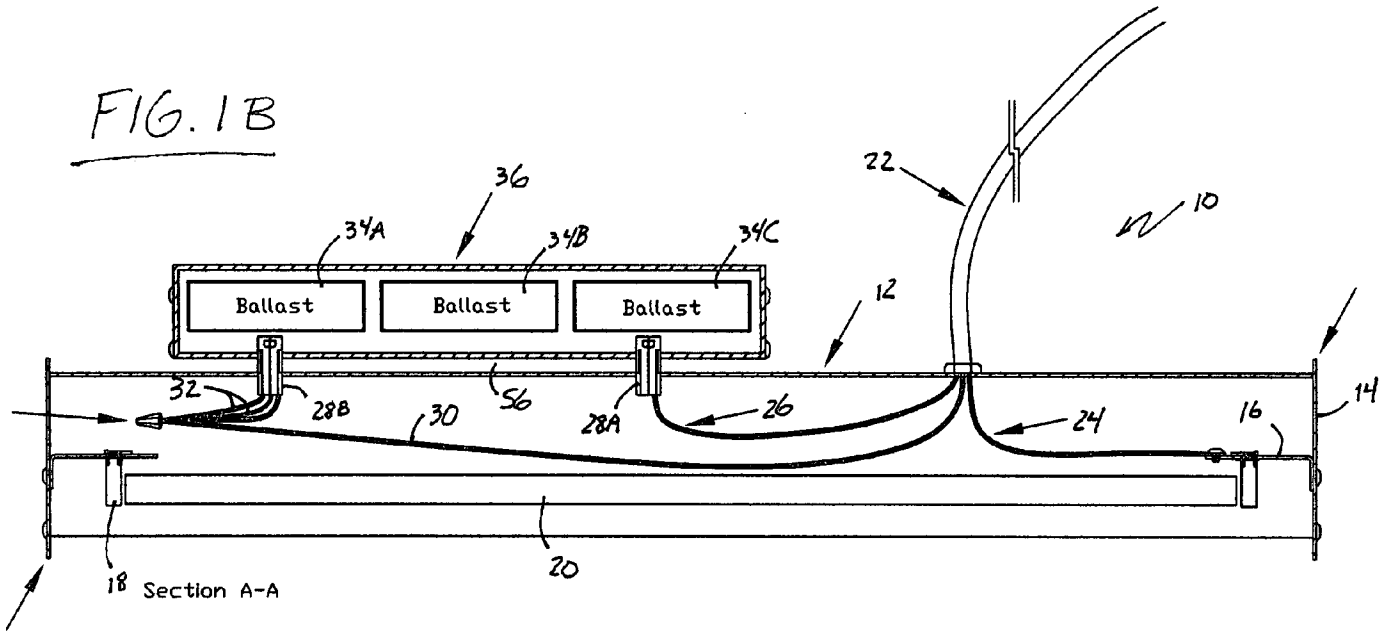

In more detail and with reference to the figures, a first embodiment of the modular light fixture of the present invention is indicated at reference numeral 10. Fixture 10 is comprised of shroud 12 and end plate 14, with socket brackets 16 mounted to the end plates 14 for receiving sockets 18 for supporting and making the electrical connection to a lamp 20 in the manner known in the art. The fixture 10 receives electrical power through conduit 22 comprised of three wires, all as known in the art, the ground 24 and neutral 26 wires being wired to the socket 18 and to a connector 28B described below and the third (supply) wire 30 being wired to connector 28A.

Figure 2B:
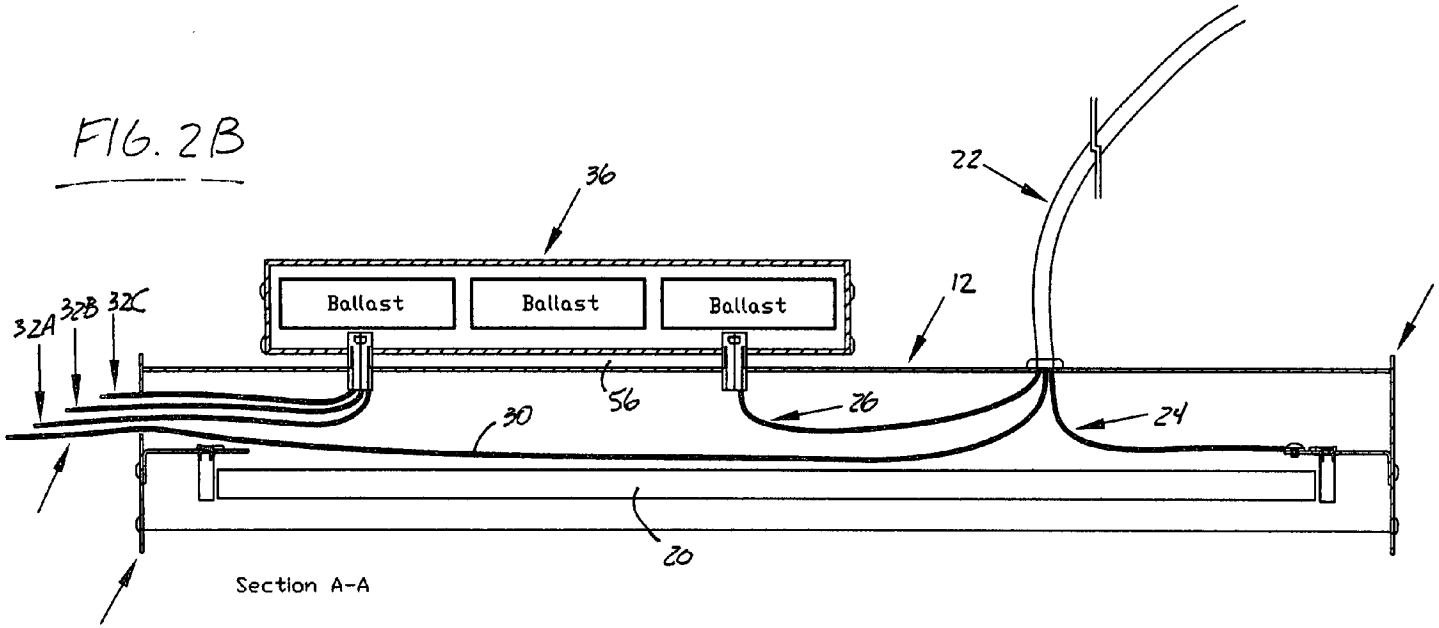
FIGS. 2A and 2B show the same modular light fixture shown in FIG. 1A, but in which the wiring is configured for mounting a controller to the fixture.
Figure 3A:
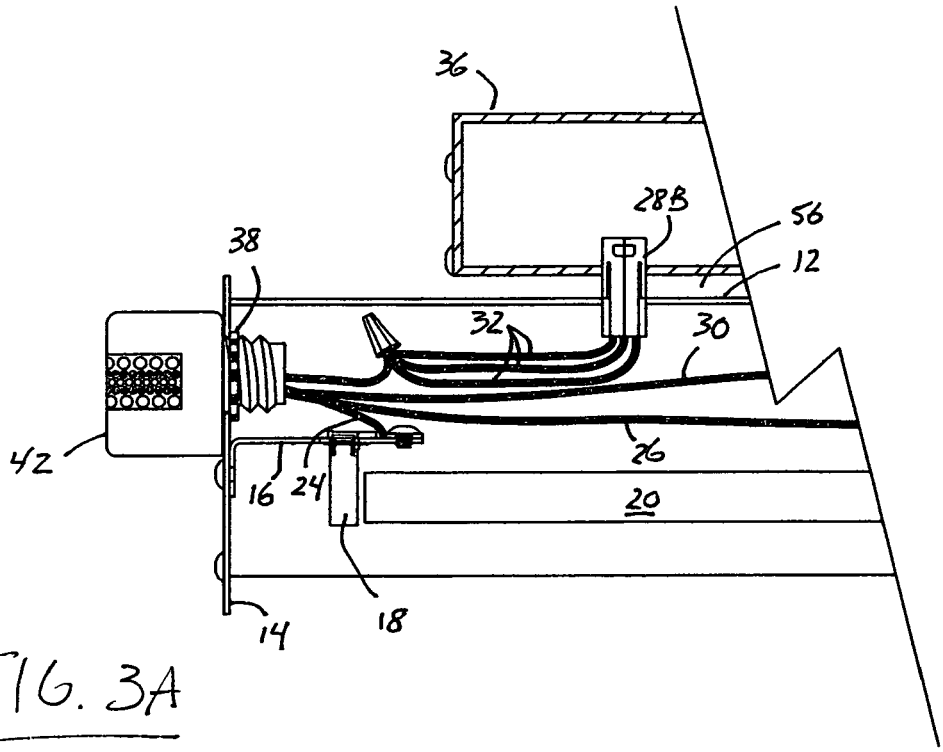
FIGS. 3A and 3B show detailed sectional views of a portion of the light fixture of FIG. 2 having different types of controllers mounted thereto.
Figure 3B:
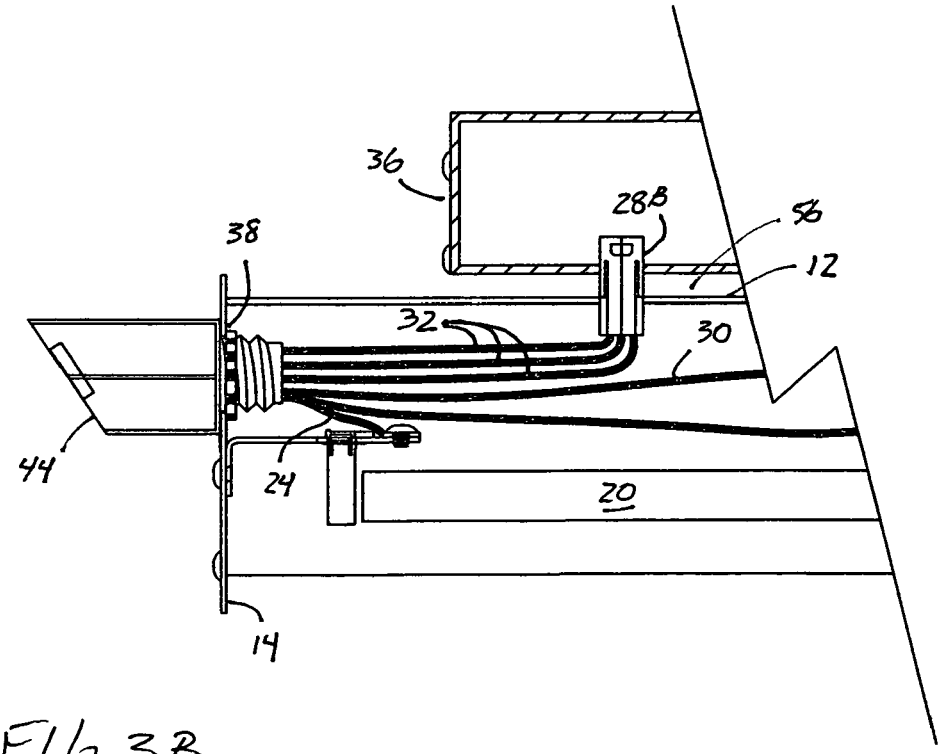

As shown in FIG. 1B, supply wire 30 is tied to three ballast wires 32A, 32B, 32C, corresponding to the three ballasts 34A, 34B, and 34C mounted in ballast module 36, the fixture shown in FIG. 1B being wired for all three ballasts 34 to simultaneously energize a corresponding lamp (or in the more usual configuration, a corresponding pair of lamps in a six-lamp fixture). Referring to FIG. 2B, it can be seen that the supply wire 30 and three ballast wires 32 are pulled through a hole 38, which can be formed as a knock-out in end plate 14 or pre-formed in the end plate and closed off by a grommet or other plug, for wiring as described below for separate switching of the ballasts 34. Referring to FIGS. 3A and 3B, two different controllers (indicated generally at reference numeral 40) for the modular fixture 10 are shown, the first being a photocell 42 (FIG. 3A) for switching all lamps 20 in fixture 10 on and off and the second being a controller 44 (FIG. 3B) of the type described in the above-incorporated application Ser. No. 12/284,394, POINT OF USE AND NETWORK CONTROL OF ELECTRICAL APPLIANCES AND METHOD, for switching individual lamps 20 (or pairs of lamps 20) on and off as light output is stepped up and/or dimmed in accordance with the methods described in that co-pending International Application as each ballast 34A, 34B, 34C is energized.

Figure 4:
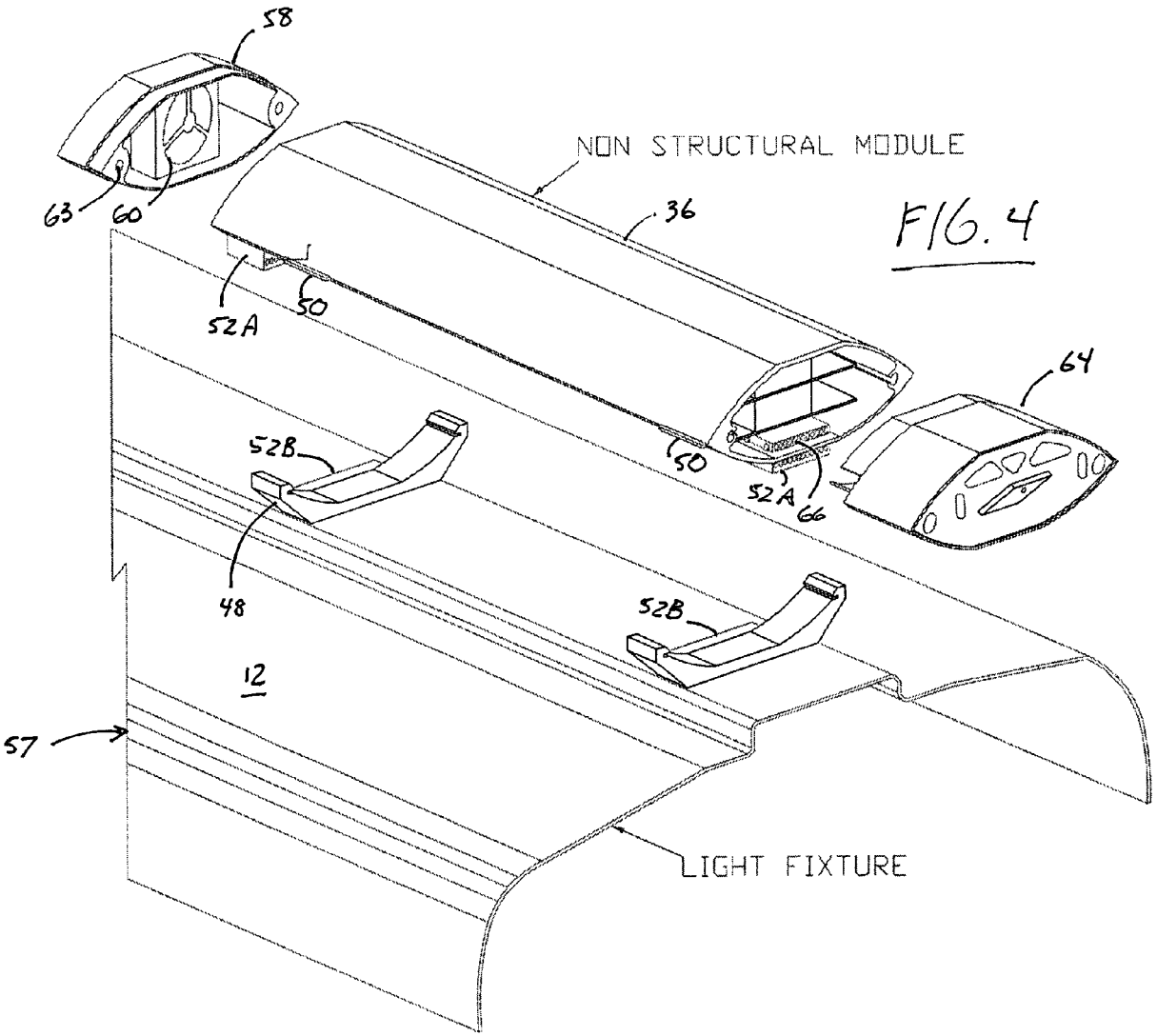
FIG. 4 is a perspective view of a second embodiment of a modular light fixture constructed in accordance with the teachings of the present invention.

Connectors 28A, 28B are shown schematically in FIGS. 1 and 2, but a preferred embodiment of the connectors is shown in detail in FIG. 4. Referring to FIG. 4, means is provided for affixing the ballast module 36 to shroud 12 in the form of a mount, indicated at reference numeral 46, comprised of a stand-off 48 mounted to shroud 12 and guides 50 formed integrally with or mounted to ballast module 36. Male and female electrical connector halves 52A, 52B are mounted to shroud 12 and ballast module 36 is mounted to shroud 12 on mount 46 by engaging the guides 50 to stand-off 48 and then sliding ballast module 36 relative to shroud 12 until the two halves 52A, 52B of electrical connector 28A, 28B are firmly seated in one another. A spring-loaded lock pin 54 is provided at the end of ballast module 36 opposite the direction in which ballast module 36 slides into position on mount 46 that pops up when the two halves 52A, 52B of electrical connectors 28A, 28B are firmly seated so as to provide an affirmative latch and to signal the mating of the connector halves 52A, 52B. As set out above, when seated in this manner, the connectors 28A, 28B operably connect the ballasts (not shown in FIG. 4) in ballast module 36 into the electrical circuit into which fixture 10 is wired.

Those skilled in the art will recognize that the connectors 28A, 28B need not be formed in the shape of a right angle as shown in FIG. 4 to provide the advantages of the modular fixture 10 of the present invention. Although not shown in detail in FIGS. 1 and 2 (hence the characterization of those figures as being schematic), connectors 28 can be linear rather than formed in a right angle as shown in FIG. 4. Further, although it may not be as sturdy (depending upon the construction of the connectors) and may not offer the advantage of confirmation of a positive lock between the halves 52A, 52B of the right-angle connectors 28A, 28B shown in FIG. 4, those skilled in the art will recognize that the connectors 28A, 28B may themselves form the mount 46 comprising one component of the modular fixture of the present invention. An important feature of the invention, regardless of the form of the connectors 28A, 28B and/or inclusion of the stand-offs 48 and guides 50, is the spacing of the halves 52B of connectors 28A, 28B on the shroud 12 of fixture 10 at a standard distance (see line 54 on either of FIG. 1B or 2B) so that a ballast module having the halves 52A of connectors 28A, 28B spaced at that same standard distance 54 can be quickly and conveniently removed from or mounted to fixture 10, regardless of the manufacturer of the component parts of fixture 10.

Figure 1A:
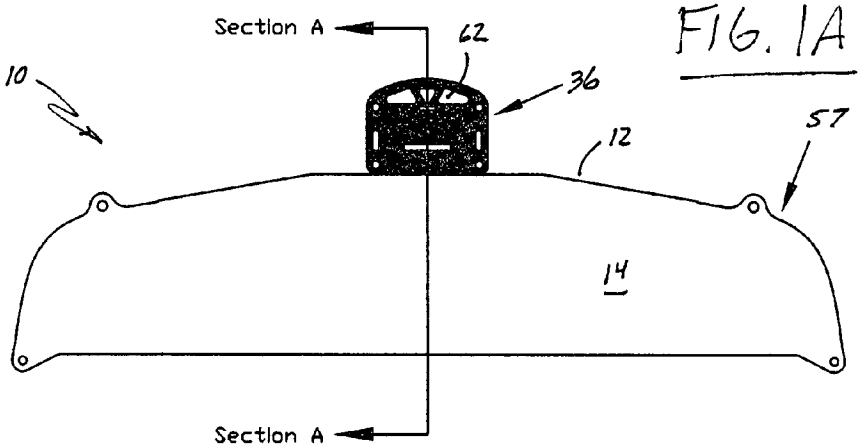
Figure 2A:
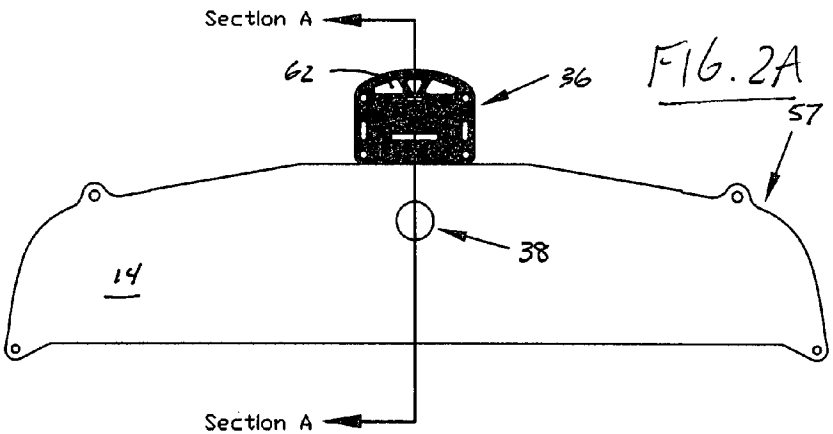

As noted above, the modular fixture 10 of the present invention offers a number of advantages over the construction of prior light fixtures, and a primary advantage of the utilization of a mount 46, regardless of whether the mount 46 is comprised of stand-offs 48 and guides 50 as shown in FIG. 4 or is incorporated into the construction of the connectors 28A, 28B as shown in FIGS. 1 and 2, is the management of temperature in the fixture. Specifically, because the lamps 20 in fixture 10 operate more efficiently at higher temperature, the lamps 20 are positioned under shroud 12 and shroud 12 is preferably manufactured as a continuous piece of metal such as aluminum that contains and reflects the heat back from the surface of the underside of shroud 12. An additional advantage of aluminum construction of shroud 12 is the ability to polish the undersurface of the shroud to better reflect both light and heat and (because aluminum can be extruded, allowing for complex shapes) to form fins, ridges, or other structure on the top surface of shroud 12 to increase the surface area of that top surface to better radiate heat. This construction directs heat away from ballast module 36 and the ballasts 34A, 34B, 34C contained therein which are, as described above, sensitive to heat in that both their operating efficiency and their lifetime may be compromised by exposure to heat. In one embodiment, any structure formed on the top surface of shroud 12 to increase the surface area (and heat dissipation characteristics) of shroud 12 is formed on surfaces located at a distance away from ballast module 36 such as at the lateral margins of shroud 12 as indicated at the arrow 57 on FIGS. 1A and 2A. Further passive thermal management is accomplished by the air gap 56 (best shown in FIGS. 1 and 2, but also a feature of the mount 36 shown in FIG. 4) between the top surface of shroud 12 and the underside of ballast module 36 that serves to insulate the temperature sensitive electronics, such as the ballasts 34, from the heat produced by the lamps 20 in modular fixture 10. Although not shown in the figures, additional passive thermal management is accomplished by the addition of a layer of epoxy with thermal insulative properties, or other type of insulation, on the surface of ballast module 36 (or on the inside surface of ballast module 36) facing shroud 12 when mounted on mount 36.

In certain operating environments, the above-described passive thermal management capabilities of the modular fixture 10 of the present invention may not be sufficient to maximize the operating efficiency and service life of lamps 20 and ballasts 34. When fixture 10 is utilized in such operating environments, it is quickly and conveniently upgraded to incorporate active thermal management capability by adding a fan module 58 as shown in FIG. 4. Fan module 58 includes a small, low voltage exhaust fan 60, switched on and off at user-selectable temperature under control of a thermostat (not shown) or other suitable device as known in the art, for pulling ambient air through the openings 62 (see FIGS. 1A and 2A) through ballast module 36 to decrease the temperature to which the ballasts 34 in ballast module 36 are exposed. Although shown as being mounted to ballast module 36 by screws (not shown) threaded through screw holes 64 in FIG. 4, to illustrate the ease with which modular fixture 10 is upgraded to active thermal management, fan module 58 can be clipped (for instance, by spring-loaded clips that interact with complimentary-shaped detents or other structure formed on the inner or outer surface of ballast module 36) or its housing can be simply sized so that it fits by frictional engagement over the outside surface of ballast module 36.

The fan module 58 for active thermal management described in the preceding paragraph is but one example of the ease with which the modular fixture 10 of the present invention may be upgraded. Referring again to FIG. 4, it can be seen that a control module 64 can also be mounted to ballast module 36, preferably on the end of ballast module 36 opposite the end on which the fan module 58 is mounted (and in the embodiment shown, it can be seen that a friction fit such as is described above is utilized for mounting the control module 64 to ballast module 36). In one embodiment, control module 64 includes all the circuitry and electronics needed for "smart" control of the lamps 20 in fixture 10 as part of a network as described in the above-incorporated co-pending application Ser. No. 12/284,394, POINT OF USE AND NETWORK CONTROL OF ELECTRICAL APPLIANCES AND METHOD. Those skilled in the art who have the benefit of this disclosure will recognize that the control module 64 described herein includes the same circuitry and electronics included in the controller 44 (see FIG. 3B), if utilized, and that there is no reason to mount both a controller 44 and a control module 64 on the same fixture 10.

In describing the upgrading of the modular fixture of the present invention by inclusion of control module 64, the advantage of the right-angle connectors 28A, 28B shown in FIG. 4 is made apparent. Specifically, the two halves 52A, 52B of each of connectors 28A, 28B include multi-pin connectors (indicated generally at reference numeral 66), enabling the use of a connector halve 52A on control module 64 (not visible in FIG. 4 because of the angle of the perspective view) to engage the proper pins of the multi-pin connector 66 of connector 28B to accomplish all the electrical connections needed to control the lamps 20 of fixture 10 in the manner described in co-pending application Ser. No. 12/284,394, POINT OF USE AND NETWORK CONTROL OF ELECTRICAL APPLIANCES AND METHOD.

From the above description of fan 58 and control 64 modules, it can be seen that the modular fixture 10 of the present invention is easily upgraded for use in a particular installation and/or operating environment, or retrofit for a particular installation and/or operating environment, in true "plug and play" fashion and without changing the structure of the fixture 10. It is further apparent that when the fixture does need service, it need not be dis-assembled to, for instance, access the ballasts, nor does it require re-wiring. Instead, the ballast module 36 (and/or one or both of a fan 58 or control 64 modules, if utilized in the particular installation) is quickly and easily detached from the fixture and replaced with a new module 36 and without exposing the electrician to high voltage.

Those skilled in the art who have the benefit of this disclosure will recognize that the light fixture of the present invention provides a level of adaptability and ease of assembly that allows the fixture to be utilized in many installations, the fixture being assembled on-site as needed for the particular installation and serviced on-site by detaching and replacing the controller without dis-assembling the fixture and/or disconnecting any wires quickly and with minimal exposure to electrical current. It will also be apparent that although the description set out herein is a description of a light fixture in which fluorescent lamps are mounted, the present invention also contemplates the mounting of other lamps in the fixture of the present invention. For instance, halogen lamps generate substantial heat such that the light fixture described herein is particularly well suited for use in a fixture utilizing halogen lamps because the lamps are separated and insulated from the electronic components by the compartmentalization of the electronics. The light fixture of the present invention is also adaptable for use with LED light sources and metal halide fixtures. All such changes, and others that will be clear to those skilled in the art from this description of the preferred embodiment(s) of the invention, are intended to fall within the scope of the following, non-limiting claims.

What is claimed is:

1. A light fixture comprising a shroud;

at least two sockets mounted in said shroud, said sockets being adapted for supporting and making electrical connection to one or more lamps mounted thereto;

first and second connectors mounted to said shroud and electrically connected to said sockets; and a ballast module detachably mounted to said connectors outside of said shroud, said ballast module comprising the electrical circuitry for energizing and operating the lamps, the electrical connections between said sockets and said ballast module being made when said ballast module is mounted to said connectors.

2. The light fixture of claim 1 wherein said first and second connectors are spaced at a specified distance from each other on said shroud.

3. The light fixture of claim 1 wherein said shroud is provided with a mount for an external controller.

4. The light fixture of claim 1 additionally comprising an air gap between said ballast module and said shroud when said ballast module is mounted to said connectors.

5. The light fixture of claim 1 additionally comprising a thermostatically-controlled fan for cooling said ballast module.

6. The light fixture of claim 1 additionally comprising a fan mounted to said ballast module for cooling said ballast module.

7. The light fixture of claim 1 wherein said ballast module additionally comprises a control module operably connected to the electrical circuitry for energizing and operating the lamps, said control module comprising electrical circuitry for controlling the lamps and adapted for interacting with a wireless control network.

8. A method of managing the heat produced by operating a light fixture comprising the steps of:

containing the heat produced by the lamps of the fixture within a shroud; and isolating the heat-sensitive electrical components for energizing the lamps in the fixture from the heat produced by the lamps of the fixture by mounting a module containing the heat-sensitive electrical components to the outside of the shroud with an air gap between the shroud and the module.

9. The method of claim 8 additionally comprising directing the heat produced by the lamps of the fixture away from the module mounted to the shroud.

10. The method of claim 8 additionally comprising cooling the heat-sensitive electrical components within the module by drawing ambient air through the module.

* * * * *